US007490821B2

(12) United States Patent
Müller et al.

(10) Patent No.: US 7,490,821 B2
(45) Date of Patent: Feb. 17, 2009

(54) METHOD AND APPARATUS FOR PRODUCING FINAL PRINTED PRODUCTS

(75) Inventors: Erwin Müller, Dürnten (CH); Markus Felix, Richterswil (CH)

(73) Assignee: Ferag AG, Hinwil (CH)

( * ) Notice: Subject to any disclaimer, the term of this patent is extended or adjusted under 35 U.S.C. 154(b) by 316 days.

(21) Appl. No.: 11/225,682

(22) Filed: Sep. 13, 2005

(65) Prior Publication Data

US 2006/0055101 A1 Mar. 16, 2006

(30) Foreign Application Priority Data

Sep. 15, 2004 (CH) ..... 1516/04

(51) Int. Cl.
*B65H 29/00* (2006.01)

(52) U.S. Cl. ..... 270/52.23; 270/52.14; 270/52.16; 270/52.22; 270/52.19

(58) Field of Classification Search ..... 270/52.14, 270/52.16, 52.19, 52.22, 52.23, 52.24, 52.25
See application file for complete search history.

(56) References Cited

U.S. PATENT DOCUMENTS

| | | | | |
|---|---|---|---|---|
| 3,722,877 | A * | 3/1973 | Wetter | 270/52.23 |
| 4,416,448 | A | 11/1983 | Meier | |
| 4,709,910 | A * | 12/1987 | Honegger | 270/52.3 |
| 4,723,770 | A * | 2/1988 | Seidel et al. | 270/52.2 |
| 4,729,554 | A | 3/1988 | Honegger | |
| 4,743,005 | A * | 5/1988 | Reist | 270/52.22 |
| 4,867,429 | A * | 9/1989 | Infanger | 270/52.2 |
| 5,388,816 | A * | 2/1995 | Petersen | 270/52.23 |
| 5,443,250 | A * | 8/1995 | Gosslinghoff | 270/52.23 |
| 6,234,466 | B1 * | 5/2001 | Infanger | 270/52.23 |
| 6,311,968 | B1 | 11/2001 | Linder et al. | |
| 2002/0166307 | A1 | 11/2002 | Hansen | |

FOREIGN PATENT DOCUMENTS

| | | | |
|---|---|---|---|
| CH | 649 267 | A | 5/1985 |
| EP | 0 237 701 | A | 9/1987 |
| EP | 0 301 244 | A1 | 2/1989 |
| EP | 0 911 289 | A1 | 4/1999 |
| EP | 1 243 538 | A | 9/2002 |
| WO | WO 98/33656 | A1 | 8/1998 |

* cited by examiner

*Primary Examiner*—Gene Crawford
*Assistant Examiner*—Leslie A Nicholson, III
(74) *Attorney, Agent, or Firm*—Alston & Bird LLP

(57) ABSTRACT

Two folded and printed products (11, 12) are introduced into a pocket-like holding compartment (1) with respective ones of their side surfaces resting against each other and are moved in such position jointly along a processing section in a direction running transversely with respect to the folded edge. In the course of this movement, the printed products (11, 12) are displaced in opposite directions (H, I) relative to each other in the direction of their folded edge and toward opening elements (7, 8). The opening elements (7, 8) move between the two halves (11*a*, 11*b*; 12*a*, 12*b*) of the two printed products (11, 12) and have the effect that the two product halves (11*a*, 11*b*; 12*a*, 12*b*) are lifted off each other. Inserts are then inserted into the printed products (11, 12) opened simultaneously in this way. In a second embodiment, first and second clamping fingers (107, 111) act in conjunction with a pivotable separating element (113) to open the two printed products.

26 Claims, 6 Drawing Sheets

A
E
1
2
3
4
5
7
8
9
10
11
11a
11b
12
12a
12b
15
16
17
18

102
103
101
104
105
106
107
109
110
111
112
113
113b
114
115
116
118
118a
118b
118c
119
119a
119b
119c
120
121
122
123
124
125
126
K
L
A

METHOD AND APPARATUS FOR PRODUCING FINAL PRINTED PRODUCTS

BACKGROUND OF THE INVENTION

The present invention relates to a method and an apparatus for producing final printed products which include inserts.

In EP-A-O 911 289 and the corresponding U.S. Pat. No. 6,311,968, a method of this type and a corresponding apparatus are described. In this known method, first of all a first folded and closed main product is introduced into a pocket-like holding compartment and is subsequently opened during its movement along the processing path. Inserts (partial products and/or enclosures) are inserted into the opened main product. Once this insertion operation has been completed, the main product with the inlays located inside is closed and placed against one wall of the holding compartment. A second folded, closed main product is then guided into the same holding compartment and, in the same way as the first main product, is opened during its movement along the processing path, is provided with inserts and is then closed. At the end of the processing path, the two finished, closed end products, which each consist of the main product and inserts inserted into the latter, are removed from the holding compartment.

In this known method, the two main products are guided into a holding compartment one after another and provided with inserts. The finishing of the two end products in the same holding compartment is thus carried out along two successive sections of the processing path. The processing path is therefore comparatively long. The end product that is finished first remains in the processing path during the production of the second end product and is removed from said processing path after the second end product has been finished.

The present invention is, then, based on the object of providing a method and an apparatus of the type mentioned above in which printed products consisting of a printed product and inserts can be produced with little expenditure on time and apparatus.

SUMMARY OF THE INVENTION

The above and other objects and advantages of the invention are achieved by the provision of a method and apparatus wherein at least two folded and closed printed products are introduced into a pocket-like holding compartment which moves in a conveying direction along a processing section. Also, the conveying direction is transverse to the folded edges of the products. During their movement, each printed product is opened and at least one insert is inserted into each opened product. Before being opened, the introduced products have respective side surfaces which rest against each other and the products are subsequently moved in this position jointly along the processing section.

The fact that the opening of the printed products and the insertion of the inserts are carried out while the two printed products are moved together along the processing section with their side surfaces resting against each other means that the processing section required to finish the two printed products is comparatively short. In addition, the expenditure on apparatus can be kept low.

Preferred further refinements of the method according to the invention and of the apparatus according to the invention are described below.

In the following text, by using the drawings, exemplary embodiments of the subject matter of the invention will be explained in more detail.

DETAILED DESCRIPTION OF THE PREFERRED EMBODIMENTS

Figure 1C:
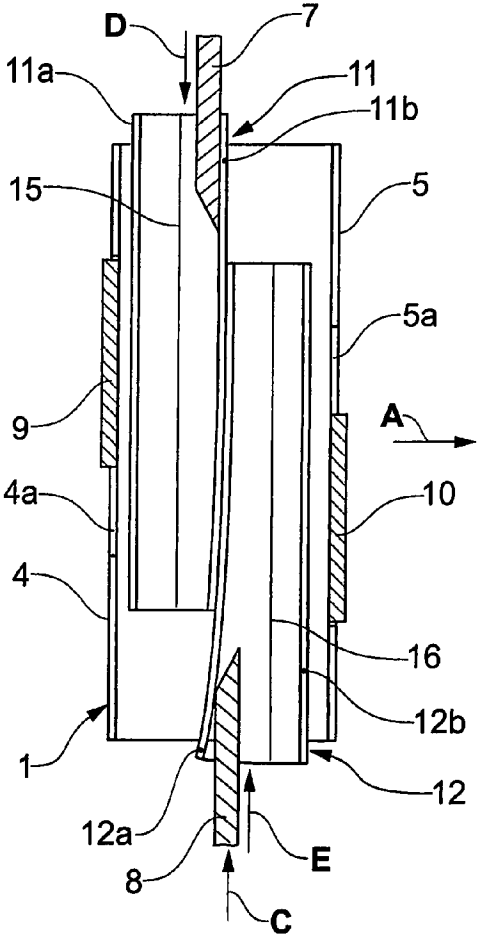
FIGS. 1*a*-1*c* show, in plan views of a pocket-like holding compartment, successive steps in the implementation of a first exemplary embodiment of the invention.
Figure 1B:
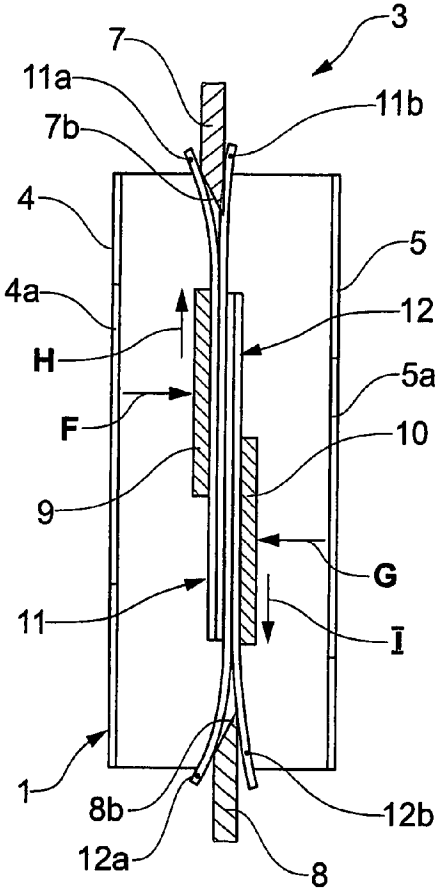
Figure 1A:
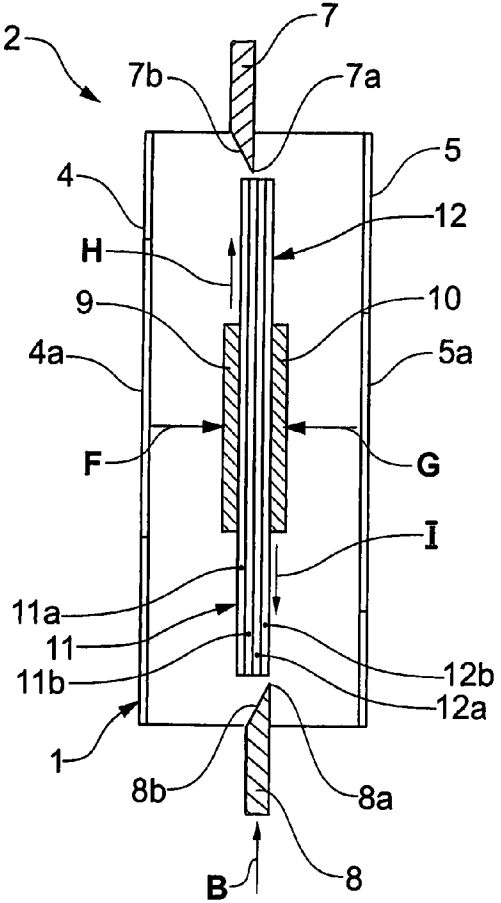
Figure 3:
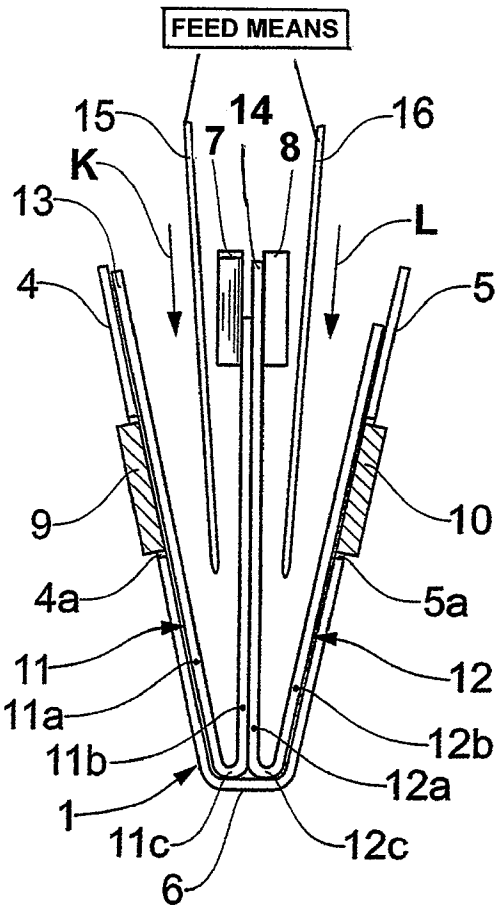
FIG. 3 shows the method step illustrated in FIG. 1*c* in an end view of the holding compartment.
Figure 2:
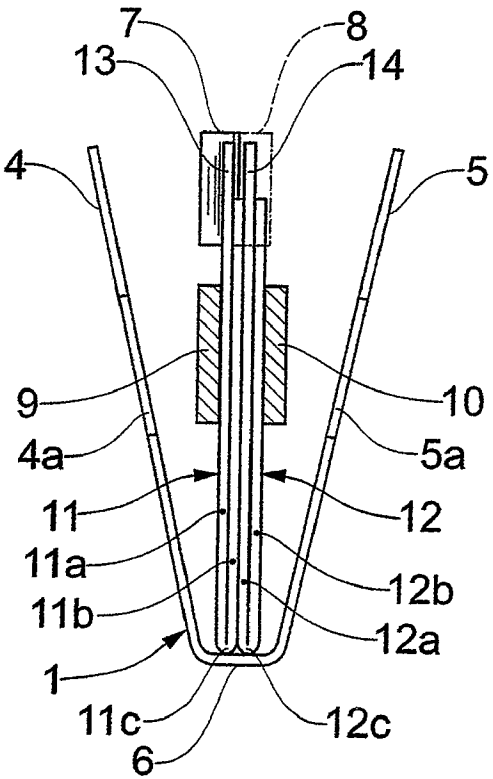
FIG. 2 shows the method step illustrated in FIG. 1*a* in an end view of the holding compartment.

Pocket-like holding compartments 1 of a conveying device 2, whose conveying direction is designated A, are shown in FIGS. 1*a* to 1*c*. The holding compartments 1 are arranged one after another in the aforementioned conveying direction A and are moved in the conveying direction A along a processing section 3 in a manner known per se but not specifically illustrated. FIGS. 2 and 3 show the holding compartments 1 illustrated in FIGS. 1*a* and 1*c* in the direction of the arrows B and C in FIGS. 1*a* and 1*c*. Each holding compartment 1 has two compartment walls 4 and 5 which are opposed and transverse with respect to the conveying direction A, which are connected to each other by a base 6.

Figure 4:
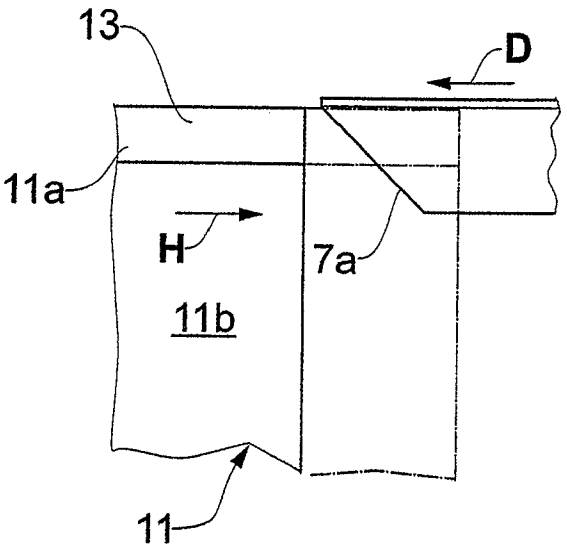
FIG. 4 shows the start of opening a printed product in side view.

Each holding compartment 1 is assigned two opening elements 7 and 8, whose ends are wedge-shaped (FIGS. 1*a*, 1*b*, 1*c*). The opening elements 7, 8 have a plunging edge 7*a*, 8*a* running obliquely (FIG. 4). The opening elements 7, 8 can be moved toward each other and away from each other in opposite directions E and D. Furthermore, each holding compartment 1 includes two slide elements 9 and 10, which can be moved toward each other and away from each other in the direction of the arrows F and G.

In each holding compartment 1 there are two folded printed products 11, 12, each of which is part of a final printed product. Each printed product 11, 12 has two product halves 11*a*, 11*b* and 12*a*, 12*b*, which are joined to each other along a folded edge 11*c*, 12*c*. One product half 11*a* and, respectively, 12*a* of each printed product 11, 12 has a projecting edge section 13 and 14, respectively, which projects beyond the other product half 11*b*, 12*b*, respectively (FIGS. 2 and 3). This projecting edge section 13, 14 is also called a prefold. The two printed products 11, 12 rest against each other with one of their side surfaces. More precisely, the outside of the shorter product part 11*b* of the printed product 11 rests against the outside of the longer product part 12*a* of the other printed product 12. The two printed products 11, 12 are moved along the conveying section 3 together in this position, as FIGS. 1*a* to 1*c* show.

The progress of an insertion operation will now be explained by using FIGS. 1*a* to 1*c* and FIGS. 2 to 4. In this case, successive method steps are shown in FIGS. 1*a* to 1*c*.

First of all, by means of a feed device, not specifically illustrated, two printed products 11, 12 are guided into a holding compartment 1 in such a way that, touching a side surface, they rest with their folded edge 11*c*, 12*c* on the compartment base. The printed products 11, 12 can be guided into the holding compartment 1 together or one after the other. The slide elements 9, 10 are then displaced toward each other in the direction of the arrows F, G into a clamping position. In this clamping position, the two slide elements 9, 10 hold the two printed products 11, 12 resting against each other between themselves (FIG. 1*a*).

Then, the slide elements 9, 10 are displaced in the direction of the association opening elements 7 and 8, in the direction of the arrows H and I. In the process, each slide element 9 and 10 carries the associated printed product 11 and 12 with it. This means that the printed products 11, 12 are displaced in opposite directions in relation to each other and toward the associated opening element 7 and 8, as FIG. 1*b* shows. For a more detailed description of the construction and the amount of action of the slide elements 9, 10, reference is made to EP-A-0 301 244, and corresponding U.S. Pat. No. 4,867,429, in particular FIG. 6. The disclosures of these documents are expressly incorporated herein by reference.

As FIGS. 1*b* and 4 reveal, the opening elements 7, 8 move with their plunging edge 7*a*, 8*a* in front between the two product halves 11*a*, 11*b* and 12*a*, 12*b*, respectively. In the process, the opening elements 7, 8 first act with their inclined surface 7*b*, 8*b*, respectively, on the projecting edge section 13 and 14 of the associated printed product 11 and 12.

Once the slide elements 9, 10 have reached their final displaced position, they are moved away from each other into a rest position, in which they are located in an opening 4*a*, and 5*a*, respectively, in the compartment wall 4 and 5 (FIGS. 1*c* and 3). The product half 11*a* and the product half 12*b*, respectively, can now be lifted off the other product half 11*b* and 12*a*, respectively. This lifting movement is assisted by moving the opening elements 7 and 8 in the direction of the arrows D and E between the two product halves 11*a*, 11*b* and 12*a*, 12*b* (FIG. 1*c*). With the aid of feed means, shown schematically in FIG. 3, inserts 15 and 16 can then be guided into the opening formed in this way between the two product halves 11*a*, 11*b* and 12*a*, 12*b* of the two printed products 11, 12, in the direction of the arrow K and L (FIG. 3). These inserts 15, 16 are, for example, what are known as preproducts or enclosures and form a further part of the final printed product. If desired, further inserts can be inserted into the opened printed products 11, 12.

Once the insertion operation has been completed, that is to say all the inserts have been guided into the printed products 11, 12, the opening elements 7, 8 are moved back again, which permits the printed products 11, 12 provided with inserts 15, 16 to be closed. This closure can be carried out, for example, by tilting the holding compartment 1 about an axis running transversely with respect to the conveying direction A, both printed products 11, 12 then coming into contact with the compartment wall 4 or with the compartment wall 5. However, it is also possible to move the two slide elements 9, 10 toward each other again in the direction of the arrows F, G in order to close the printed products 11, 12. By displacing the slide elements 9, 10 in a direction opposite to the arrows H and G, the printed products 11, 12 together with inserts 15, 16 can be displaced back into their original congruent position. The finished final printed products, comprising the printed products 11, 12 and one or more inserts 15, 16, can then be removed from the holding compartment 1.

By using FIGS. 5*a* to 5*c* and 6*a* to 6*c*, which, in illustrative terms, correspond to FIGS. 1*a* to 1*c*, two further exemplary embodiments of the method according to the invention, which are variants of the method explained by using FIGS. 1*a* to 1*c* and 2 to 4, will be described. In this case, in FIGS. 5*a* to 5*c* and 6*a* to 6*c*, the same designations as in FIGS. 1*a* to 1*c* will be used for mutually corresponding parts.

Figure 5C:
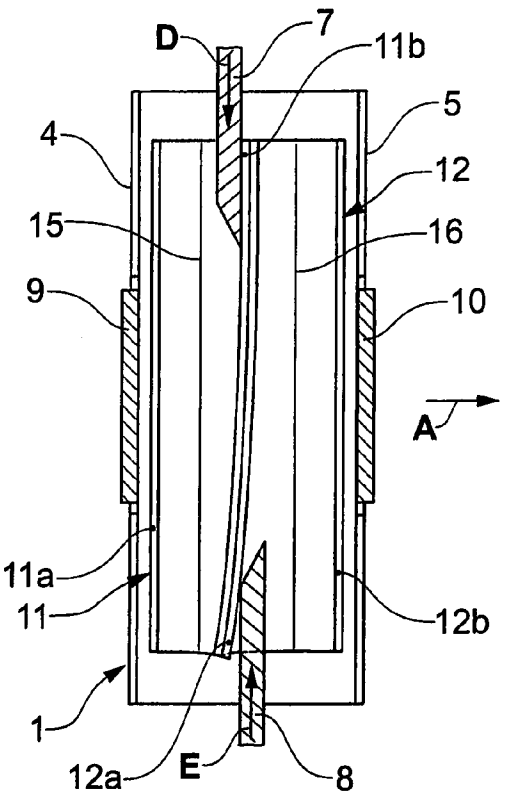
FIGS. 5*a*-5*c* shows successive method steps in the implementation of a second exemplary embodiment of the method according to the invention, in an illustration corresponding to FIGS. 1*a*-1*c*, FIGS. 6*a*-6*c* show success method steps in the implementation of a third exemplary embodiment of the method according to the invention in an illustration corresponding to FIGS. 1*a*-1*c*, FIGS. 7*a*-7*e* show method steps during the implementation of a fourth exemplary embodiment of the method according to the invention in end views of a pocket-like holding compartment.
Figure 5B:
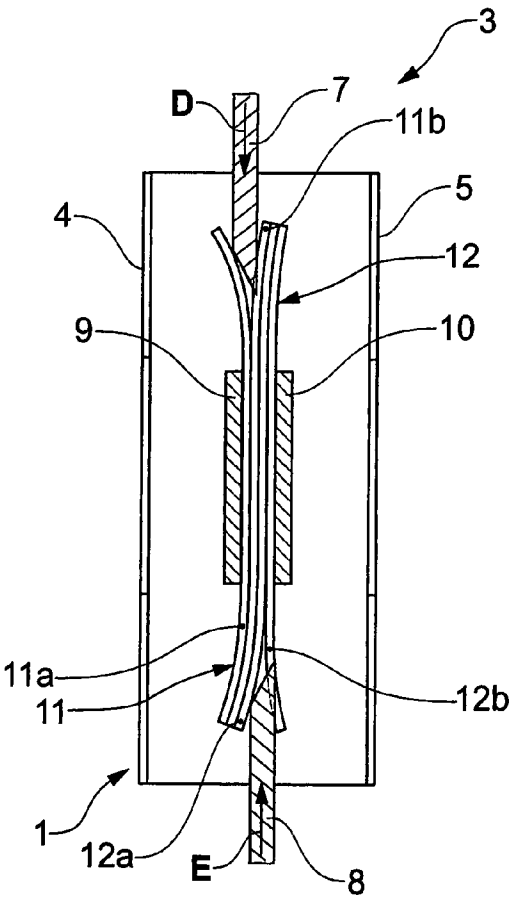
Figure 5A:
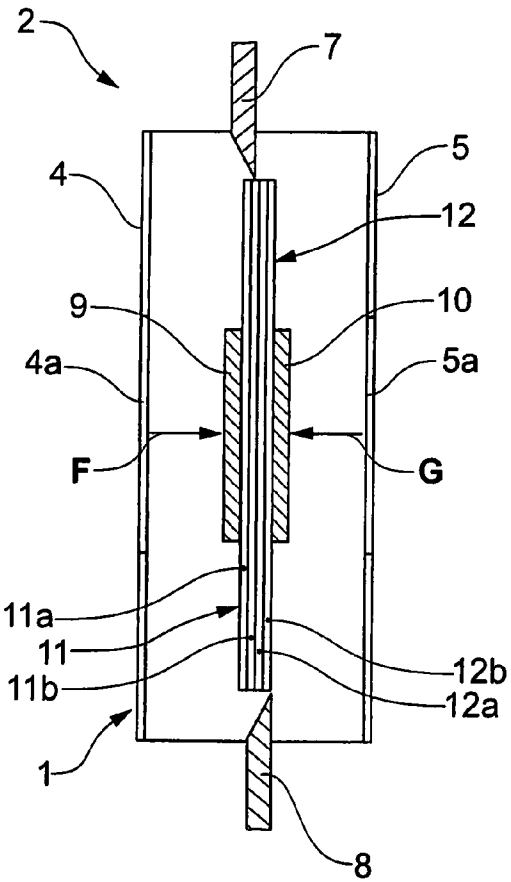

The embodiment according to FIGS. 5*a* to 5*c* differs from the embodiment according to FIGS. 1*a* to 1*c* in that the printed products 11, 12 are not displaced transversely with respect to the conveying direction A in relation to each other for the opening operation. The slide elements 9, 10 cannot therefore be displaced in the direction of the arrows H, I but only moved toward each other and away from each other in the direction of the arrows F, G.

As FIGS. 5*a* and 5*b* show, the printed products 11, 12 are pressed against each other by the slide elements 9, 10 located in their clamping position. The simultaneous opening of the two printed products 11, 12 is carried out by moving the opening elements 7, 8 in the direction of the arrows D and E. In order that the printed products 11 and 12 are able to open after the opening element 7, 8 has been moved in, the slide elements 9, 10 are moved back into their rest position shown in FIG. 5*c*.

Otherwise, the introduction of the inserts 15 and 16 and the subsequent closure of the printed products 11, 12 proceeds in the same way as described by using FIGS. 1*a* to 1*c*.

Figures 6A, 6B, 6C:
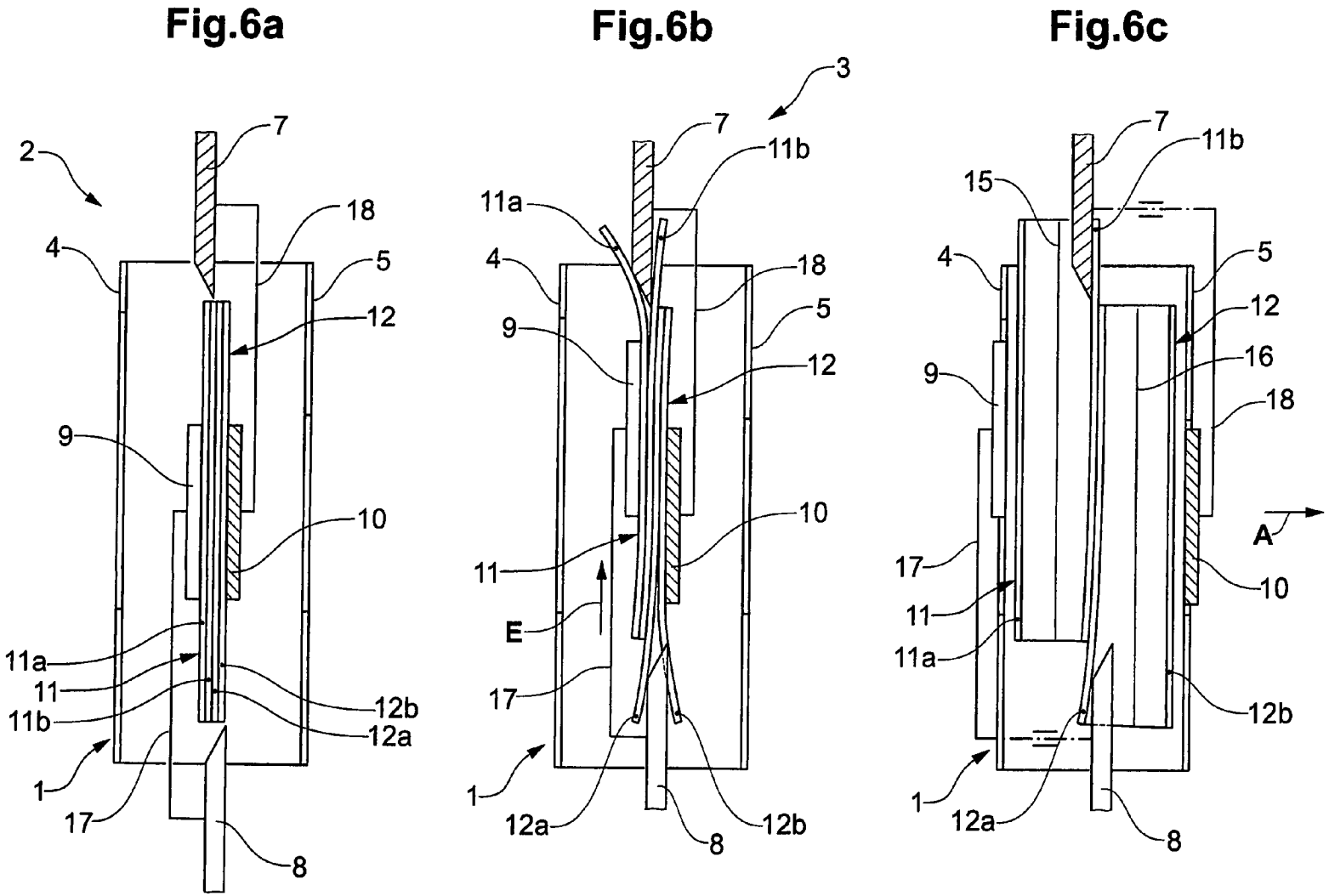

As distinct from the method described by using FIGS. 1*a* to 1*c*, in the method according to FIGS. 6*a* to 6*c* one printed product, specifically the printed product 12, remains stationary during the opening operation, while the other printed product 11 is pushed against the stationary opening element 7 by means of the associated slide element 9. In order to be able to open the stationary printed product 12, the associated opening element 8 is moved in the direction of the arrow E together with the slide element 9 (FIG. 6*b*). The driving connection between the slide element 9 and the opening element 8 is designated 17.

In an alternative embodiment, the opening element 7 and the slide element 10 are also moved together with each other, specifically in a direction which is opposite to the arrow E. The corresponding driving connection between the opening element 7 and the slide element 10 is designated 18.

In the following text, some of the many possible variants of the exemplary embodiments described above will be explained in more detail.

In the embodiment described in FIGS. 1*a* to 1*c* it would also be possible to dispense with displacing the opening elements 7 and 8 in the direction of the arrows D, E and to arrange the opening elements 7, 8 to be stationary. This measure is primarily suitable for processing printed products 11, 12 having small dimensions.

The opening elements 7, 8 can be arranged on the associated holding compartment 1 and moved together with the latter. However, it is also conceivable to arrange the opening elements 7, 8 on transport devices which are arranged beside the holding compartments 1 and move synchronously together with the holding compartments 1.

By using the exemplary embodiments shown, the processing of printed products 11, 12 having a prefold (projecting edge section 13, 14) has been explained, the printed products 11, 12 being opened in the middle in each case. However, it is also possible to open printed products 11, 12 without such a prefold 13, 14 in a corresponding manner. The opening of the printed products 11, 12 can in this case be carried out as shown by means of opening elements 7, 8 or else in another way, for example by means of an air jet.

The conveying device 2 having the holding compartments 1 can be constructed in the form of a carousel, as described in WO-A-98/33656 (FIG. 3), for example. In addition, it is also possible to construct the conveying device 2 in the manner of a drum driven in rotation, for example in a way similar to that shown in EP-A-O 301 244, but without transporting the printed products 11, 12 in the direction of the drum longitudinal axis.

Figures 7A, 7B, 7C, 7D, 7E:
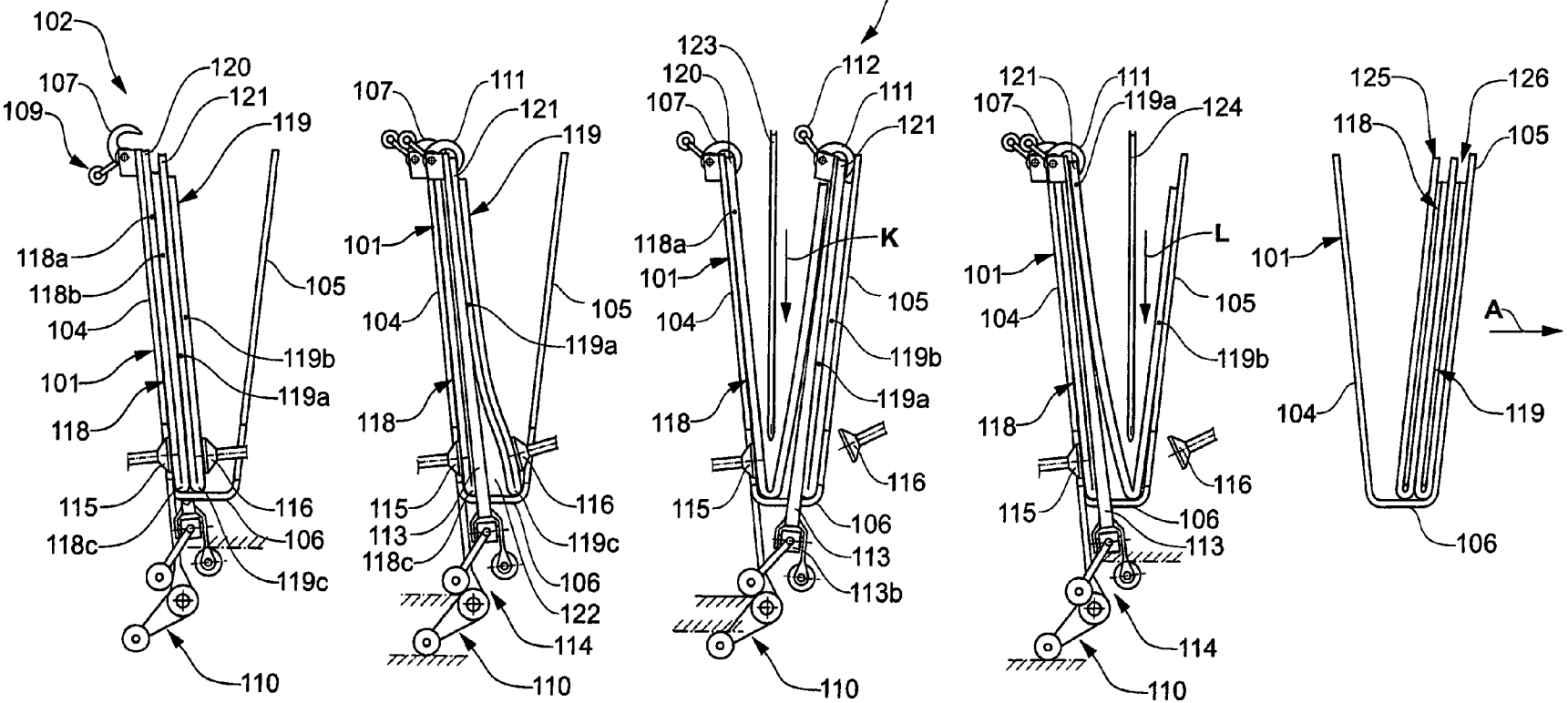

In FIGS. 7*a* to 7*e*, in which a fourth embodiment of the subject of the invention is illustrated, pocket-like holding compartments 101 of a conveying device 102, whose conveying direction is designated A, are shown. The holding compartments 101 are arranged one after another in the conveying direction A and are moved in this conveying direction A in a manner known per se but not specifically illustrated along a processing section 103. FIGS. 7*a* to 7*e* show a holding compartment 101 from the side, seen in the direction of the arrow M in FIG. 8. In this FIG. 8, a holding compartment 101 is illustrated in a view in the direction of the arrow N (FIG. 7*b*). Each holding compartment 101 has two opposite compartment walls 104, 105 which extend transversely with respect to the conveying direction A. The compartment walls 104, 105 are connected to each other via a base 106.

Figure 8:
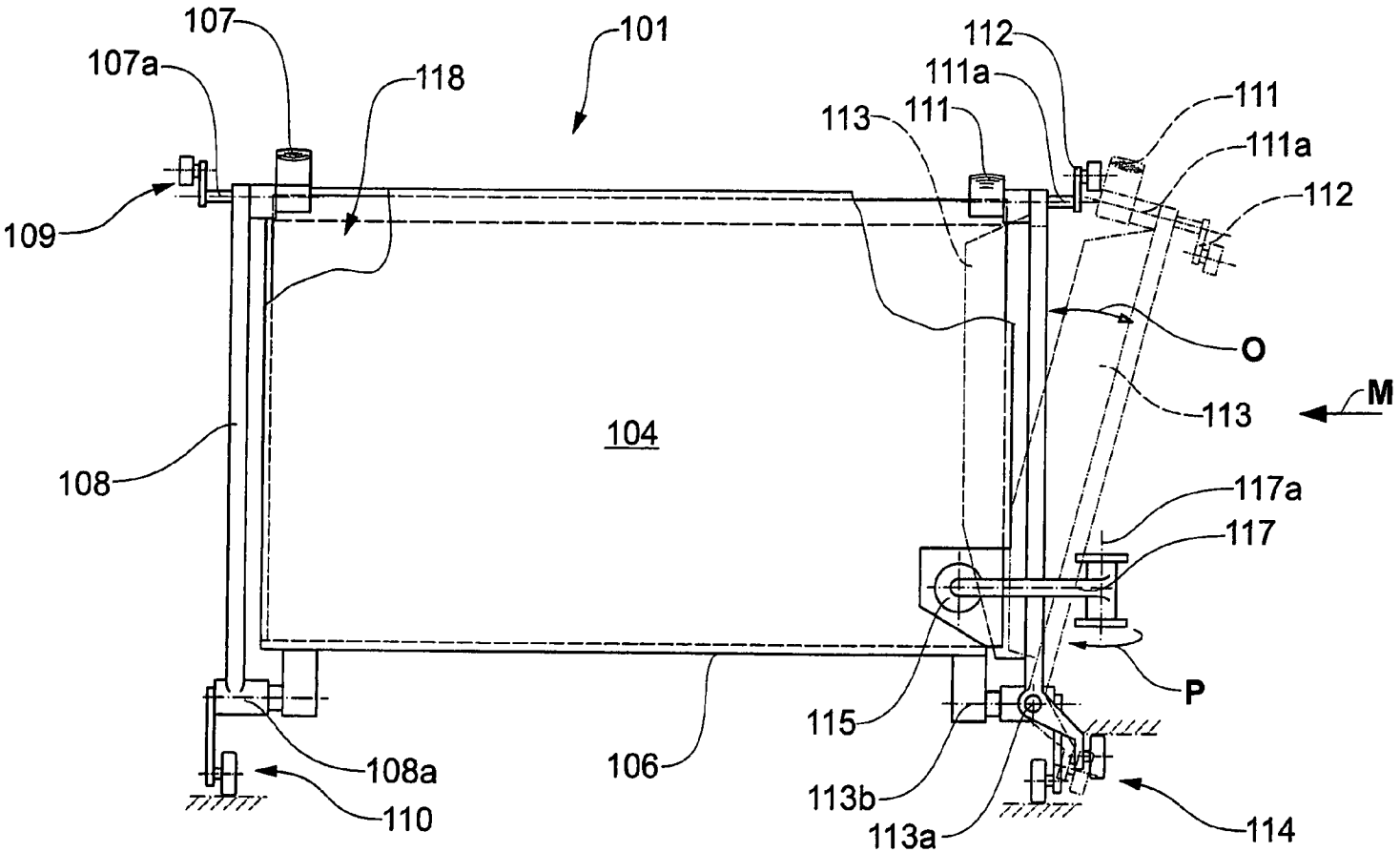
FIG. 8 shows a view of the holding compartment shown in FIGS. 7*a*-7*e*.

Each holding compartment 1 is assigned a first clamping finger 107, which is fitted to a lever 108 such that it can rotate about an axis of rotation 107*a* (FIG. 8). In order to rotate the first clamping finger 107 between an open position and a clamping position, there is a pivoting mechanism 109, merely illustrated schematically, which includes a follower roller interacting with control cams, not illustrated. The lever 108 is mounted such that it can pivot about the axis 108*a*. The lever 108 is pivoted via a pivoting mechanism 110, likewise merely illustrated schematically, which has a follower roller interacting with slotted control guides.

On the side of the holding compartment 101 opposite the first clamping finger 107, a second clamping finger 111 is provided, which can be rotated about an axis of rotation 111*a* between an open position and a clamping position. The rotation of the second clamping finger 111 is likewise carried out by means of a closing mechanism 112, which has a follow-up roller interacting with slotted control guides, not specifically illustrated. The second clamping finger 111 is fitted to a separating element 113, which is arranged at the side of the holding compartments 101. For improved clarity, the separating element 113 has been left out in FIG. 7*a*. The separating element 113 can be pivoted to the side about a first pivot axis 113*a*, between an introduced and a withdrawn position. In FIG. 8, the pivoting direction in this regard is designated by the arrow O. The withdrawn position of the separating element 113 is illustrated dash-dotted in FIG. 8. In addition, the separating element 113 can be pivoted about a second pivot axis 113*b*, which runs at right angles to the first pivot axis 113*a*, from one compartment wall 104 in the direction of the other compartment wall 105 and back, as will be explained further by using FIGS. 7*a* to 7*d*. In order to pivot the separating element 113 in the aforementioned two directions, a pivoting mechanism 114, merely illustrated purely schematically, is provided, which has follower rollers interacting with slotted control guides. Adjacent to the compartment base 106 and on the side of the separating element 113, each holding compartment 101 has a sucker arrangement, illustrated schematically, which is formed by two suction elements 115, 116. As shown in FIG. 8, each suction element 115, 116 is fixed to a pivoting arm 117, which can be pivoted about a pivot axis 117*a* running approximately at right angles to the compartment base 106. The pivoting direction of the pivoting arm 117 and therefore of the suction elements 115, 116 is indicated by the arrow P in FIG. 8.

Arranged in the holding compartments 101 are two folded printed products 118 and 119, which rest against each other with one of the outside surfaces. Each printed product 118, 119 consists of two product halves 118*a*, 118*b* and 119*a*, 119*b*. The two product halves 118*a*, 118*b* and 119*a*, 119*b* are connected to each other via a folded edge 118*c*, 119*c*, respectively. The product half 118*a* and 119*a* has a projecting edge section 120, 121, which is also designated a prefold. This projecting edge section 120, 121 projects beyond the other product half 118*b*, 119*b*. As FIG. 7*a* shows, the outside of the shorter product part 118*b* of the printed product 118 rests on the outside of the longer product part 119*a* of the other printed product 119. The two printed products 118, 119 are moved together along the conveying section 103, as FIGS. 7*a* to 7*e* show. The two printed products 118, 119 are part of a multipart final printed product.

In the following text, by using FIGS. 7*a* to 7*e*, the progress of an insertion operation will be explained. In this case, successive method steps are shown in FIGS. 7*a* to 7*e*.

First of all, by means of a feed device, not specifically illustrated, two printed products 118, 119 are guided into a holding compartment 101 such that they rest with their folded edge 118*c*, 119*c* on the compartment base 106. One printed product 118 rests with the product half 118*a* against the compartment wall 104, while the other printed product 119 rests with the product half 119*a* against the product half 118*b* of the other printed product 118. The two printed products 118, 119 can be guided into the holding compartment 101 together or one after the other. As one of the printed products 118, 119 is guided into a holding compartment 101, the two clamping fingers 107, 111 are opened, as emerges from FIG. 7*a*, in which the second clamping finger 111 is not shown, however. The separating element 113 is in the pivoted-out position (illustrated dash-dotted in FIG. 8) as the printed product 118, 119 is guided in.

The clamping finger 107 is then closed, gripping the projecting edge section 120 of the printed product 118. The two suction elements 115, 116, as shown in FIG. 7*a*, are brought into contact with the printed products 118, 119. These suction elements 115, 116 are then connected to a vacuum source, not shown, and moved away from each other. As FIG. 7*b* shows, the suction element 116 which holds the printed product 119 firmly is moved away from the other suction element 115. As a result, the printed product 119 is lifted off the printed product 118 in the region of its folded edge 119*c*. The separating element 113 is then pivoted into the holding compartment 104 and moves into the opening 122 formed between the printed products 118, 119. The separating element 113 is then located between the printed products 118, 119 and separates these (FIG. 7*b*). The closure of the second clamping finger 111, which grips the projecting edge section 121 of the other printed product 119, is then carried out.

The separating element 113 and the lever 108 having the first clamping finger 107 are then pivoted about the axes 113*a* and 108*a* in the direction of the other compartment wall 105. During this pivoting movement, the product halves 118*a* and 119*a* are held firmly by the clamping fingers 107 and 111. The first printed product 118 is then opened by pivoting the lever 108 back. Then, as shown in FIG. 7*c*, an insert 123 is guided into the opened first printed product 118 in the direction of the arrow K by feed means, not shown. It is also possible for a plurality of inserts 123 to be inserted into the open printed product 118 simultaneously or one after another.

In the next step, the separating element 113 is pivoted back about the pivot axis 113*b* against the rear compartment wall 104. In the process, the first printed product 118 is closed and the product half 119*a* of the other printed product 119, held firmly by the second clamping finger 111, is lifted off its other product half 119*b*, as FIG. 7*d* shows. An insert 124, which is fed in by feed means, not shown, is then guided in the direction of the arrow L into the second printed product 119 opened in this way (FIG. 7*d*). It goes without saying that a plurality of inserts 124 can also be inserted into the opened printed product 119 simultaneously or one after another.

The inserts 123, 124, which are parts of the finished final printed product, can be preproducts and/or enclosures.

The second clamping finger 111 is then pivoted into its open position and releases the product half 119*a* of the second printed product 119. The separating element 113 is pivoted out of the holding compartment 101 into the withdrawn position illustrated dash-dotted in FIG. 8. The lever 108, to which the first clamping finger 107 is fixed, is then pivoted forward about the pivot axis 108*a*, that is to say in the conveying direction A, toward the compartment wall 105. In the process, the second printed product 119 is closed and the two printed products 118, 119 together with inserts 125, 126 are placed against the front compartment wall 105, as illustrated in FIG. 7*e*. The first clamping finger 107 is pivoted into its open position, releasing the product half 118*a* of the printed product 118. The lever 108 is then pivoted back toward the rear compartment wall 104.

The two final printed products 125, 126, which each comprise a printed product 118, 119 and one or more inserts 123, 124, rest against each other in the holding compartment 101 (FIG. 7*e*) and can be removed from the compartment 101 together by means of a conveying device, not shown.

The printed products 11, 12 and 118, 119 are printed and can consist of a folded sheet or a plurality of folded sheets. If the printed products 11, 12; 118, 119 consist of a plurality of folded sheets, then these can be joined to one another, for example by means of staples, along the folded edge 11*c*, 12*c*; 118*c*, 119*c*.

The inserts 15, 16 and 123, 124 are preferably printed preproducts or enclosures of any type. The preproducts have one or more sheets and can likewise be folded. In the case of multi-sheet preproducts, the individual sheets can be joined to one another. Suitable enclosures are, for example, printed products but also goods samples.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A method for producing final printed products comprising the steps of introducing at least two folded and closed printed products in a pocket-like holding compartment and moving the compartment in a conveying direction running transversely with respect to their folded edges along a processing section, and during their movement, opening each printed product and inserting at least one insert into each opened printed product, and then removing from the holding compartment the finished final printed products which comprise the introduced printed products and the at least one insert, and so that the introduced printed products form an outer jacket of the finished final printed products, wherein before being opened, the introduced printed products have respective side surfaces resting against each other and are subsequently moved in this position jointly along the processing section, and wherein the printed products are opened simultaneously during their joint movement along the processing section.

2. The method of claim 1, wherein the printed products are guided into the holding compartments with each in a closed state.

3. The method of claim 1, wherein the printed products are provided simultaneously with the insert during their joint movement along the processing section.

4. The method of claim 1, wherein the mutual position of the printed products resting against each other is maintained during the opening step.

5. A method for producing final printed products comprising the steps of introducing at least two folded and closed printed products in a pocket-like holding compartment and moving the compartment in a conveying direction running transversely with respect to their folded edges along a processing section, and during their movement, opening each printed product and inserting at least one insert into each opened printed product, and then removing from the holding compartment the finished final printed products which comprise the introduced printed products and the at least one insert, and so that the introduced printed products form an outer jacket of the finished final printed products, wherein before being opened, the introduced printed products have respective side surfaces resting against each other and are subsequently moved in this position jointly along the processing section, and wherein the printed products are opened successively during their joint movement along the processing section.

6. The method of claim 5, wherein the printed products are provided successively with the insert during their joint movement along the processing section.

7. The method of claim 5, wherein the printed products are guided into the holding compartments with each in a closed state.

8. The method of claim 5, wherein the mutual position of the printed products resting against each other is maintained during the opening step.

9. A method for producing final printed products comprising the steps of introducing at least two folded and closed printed products in a pocket-like holding compartment and moving the compartment in a conveying direction running transversely with respect to their folded edges along a processing section, and during their movement, opening each printed product and inserting at least one insert into each opened printed product, wherein before being opened, the introduced printed products have respective side surfaces resting against each other and are subsequently moved in this position jointly along the processing section, and wherein the printed products resting against each other are displaced relative to each other in a direction (H, I) running parallel to the direction of their folded edge in order to open the printed products.

10. The method of claim 9, wherein during the displacement step each of the printed products is brought into contact with an opening element so that the opening elements enter the printed products in the direction of the folded edges thereof.

11. The method of claim 9, wherein the printed products are guided into the holding compartments with each in a closed state.

12. A method for producing final printed products comprising the steps of introducing at least two folded and closed printed products in a pocket-like holding compartment and moving the compartment in a conveying direction running transversely with respect to their folded edges along a processing section, and during their movement, opening each printed product and inserting at least one insert into each opened printed product, wherein before being opened, the introduced printed products have respective side surfaces resting against each other and are subsequently moved in this position jointly along the processing section, and wherein the opening step comprises in each case moving an opening element toward the printed product in the direction (D, E) of the folded edge of the associated printed product.

13. The method of claim 12, wherein the mutual position of the printed products resting against each other is maintained during the opening step.

14. The method of claim 12, wherein the printed products are guided into the holding compartments with each in a closed state.

15. A method for producing final printed products comprising the steps of introducing at least two folded and closed printed products in a pocket-like holding compartment and moving the compartment in a conveying direction running transversely with respect to their folded edges along a processing section, and during their movement, opening each printed product and inserting at least one insert into each opened printed product, wherein before being opened, the introduced printed products have respective side surfaces resting against each other and are subsequently moved in this position jointly along the processing section, and wherein the at least two printed products resting against each other are brought into contact with a wall of the holding compartment, wherein a first of the printed products is then brought into contact with the other, opposite wall of the holding compartment, wherein the other, second printed product is then opened and provided with at least one insert, and wherein the first printed product is then opened and provided with at least one insert.

16. The method of claim 15, wherein the second printed product is closed after the insertion of the insert, before the first printed product is opened.

17. The method of claim 15 wherein, in order to open the printed products, in each case one half of the printed product is held firmly.

18. The method of claim 15, wherein, in order to lift one printed product off another printed product, a separating element is moved in between the printed products resting against each other, and is then pivoted in the conveying direction (A).

19. The method of claim 18, wherein, in order to form an opening for the separating element to be moved in, the at least two printed products resting against each other are lifted off each other in the region of their folded edge.

20. The method of claim 15, wherein the printed products are guided into the holding compartments with each in a closed state.

21. An apparatus for producing final printed products, comprising a conveying device which moves along a processing section and which has pocket-like holding compartments arranged one after another in its conveying direction (A) and extending transversely with respect to this conveying direction (A), opening means assigned to each holding compartment for opening the closed printed products during their movement along the processing section, and feed means for guiding at least one insert into an opened printed product in each case during its movement along the processing section, wherein at least two printed products with their side surfaces resting against each other before they are opened are introduced into the holding compartments and moved jointly along the processing section, wherein the opening means comprises two opening elements, of which each opening element can be moved relative to the associated printed product in order to move into one of the printed products, and wherein the opening elements are mounted for movement toward each other and away from each other in opposite directions (D, E) transversely with respect to the conveying direction (A).

22. The apparatus of claim 21, wherein each holding compartment is assigned displacement means which can be displaced relative to each other transversely with respect to the conveying direction (A) and act on the printed products when in an active position.

23. An apparatus for producing final printed products, comprising a conveying device which moves along a processing section and which has pocket-like holding compartments arranged one after another in its conveying direction (A) and extending transversely with respect to this conveying direction (A), opening means assigned to each holding compartment for opening the closed printed products during their movement along the processing section, and feed means for guiding at least one insert into an opened printed product in each case during its movement along the processing section, wherein at least two printed products with their side surfaces resting against each other before they are opened are introduced into the holding compartments and moved jointly along the processing section, wherein the opening means of each holding compartment includes a separating element which can be moved transversely with respect to the conveying direction (A) in order to move in between the printed products which are resting against each other, wherein each separating element is mounted for transverse pivotal movement about a first pivot axis and between an introduced position extending into one side of the associated compartment and a withdrawn position, and wherein each separating element is also mounted for pivotal movement about a second pivot axis which runs at right angles to the first pivot axis and so that the separating element moves to and fro with respect to the compartment in the conveying direction (A) while in the introduced position.

24. The apparatus of claim 23, wherein the opening means of each holding compartment further includes a sucker arrangement for lifting the printed products which are resting against each other, in the region of their folded edge.

25. The apparatus of claim 23, wherein the opening means of each holding compartment further includes controllable clamping fingers which, in their clamping position, in each case hold a part of one of the printed products firmly.

26. A method for producing final printed products comprising the steps of introducing at least two folded and closed printed products in a pocket-like holding compartment and moving the compartment in a conveying direction running transversely with respect to their folded edges along a processing section, and during their movement, opening each printed product and inserting at least one insert into each opened printed product, wherein before being opened, the introduced printed products have respective side surfaces resting against each other and are subsequently moved in this position jointly along the processing section, wherein the opening step comprises displacing at least one of the printed products into contact with an opening element so that the opening element enters the one printed product in the direction of the folded edge thereof, wherein the opening step further comprises holding a second one of the printed products stationary during the displacing step, and wherein the opening step further comprises advancing a second opening element so that it enters the stationary printed product in the direction of the folded edge thereof.

* * * * *